US006773089B2

(12) United States Patent
Inoue et al.

(10) Patent No.: US 6,773,089 B2
(45) Date of Patent: Aug. 10, 2004

(54) LIQUID DISCHARGE HEAD, AND HEAD CARTRIDGE AND IMAGE FORMING APPARATUS USING SUCH LIQUID DISCHARGE HEAD

(75) Inventors: Tomoyuki Inoue, Kanagawa (JP); Torachika Osada, Kanagawa (JP); Michinari Mizutani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/419,853

(22) Filed: Apr. 22, 2003

(65) Prior Publication Data

US 2003/0197756 A1 Oct. 23, 2003

(30) Foreign Application Priority Data

Apr. 23, 2002 (JP) ..... 2002-121208

(51) Int. Cl.[7] ..... B41J 2/145; B41J 2/15; B41J 2/21

(52) U.S. Cl. ..... 347/40; 347/43

(58) Field of Search ..... 347/40, 41, 43

(56) References Cited

U.S. PATENT DOCUMENTS 4,215,350 A * 7/1980 Mielke et al. ..... 347/12
5,745,131 A * 4/1998 Kneezel et al. ..... 347/15
6,394,579 B1 * 5/2002 Boyd et al. ..... 347/47

FOREIGN PATENT DOCUMENTS

JP 6255132 A * 9/1994 ..... 347/43

* cited by examiner

*Primary Examiner*—Thinh Nguyen
(74) *Attorney, Agent, or Firm*—Fitzpatrick, Cella, Harper & Scinto

(57) ABSTRACT

A first array state has a first nozzle group 50 provided with first nozzles 25*a* arranged at an array pitch $d_0$, and second nozzle groups 51 each provided with first nozzles 25*a* arranged at an array pitch $d_1$. The second nozzle groups 51 are disposed on both sides of a nozzle array, and the first nozzle group 50 is disposed therebetween. A second array state has a first nozzle group 50 provided with second nozzles 25*b* arranged at the array pitch $d_0$, and second nozzle groups 52 each provided with second nozzles 25*b* arranged at an array pitch $d_2$. The second nozzle groups 52 are disposed on both sides of a nozzle array, and the first nozzle group 50 is disposed therebetween. A diameter of each first nozzle 25*a* is set greater than that of each second nozzle 25*b*, and a volume of an ink droplet discharged is also greater. The array pitch $d_1$ is set greater than the array pitch $d_2$, and the array pitch $d_0$ is set smaller than the array pitch $d_1$ and the array pitch $d_2$. This can prevent occurrence of a white stripe upon solid printing.

14 Claims, 10 Drawing Sheets

LIQUID DISCHARGE HEAD, AND HEAD CARTRIDGE AND IMAGE FORMING APPARATUS USING SUCH LIQUID DISCHARGE HEAD

BACKGROUND OF THE INVENTION

1. Field of the Invention

The present invention relates to a liquid discharge head having a nozzle for discharging liquid, and a head cartridge and an image forming apparatus that use such a liquid discharge head.

2. Description of the Related Art

In recent years, owing to the spread of the Internet, digital cameras, and so on, the demand for high-gradation color printing has been increased and, following it, ink jet printers have been improved to have higher performances. As means for obtaining a high-quality print image with high fineness and high gradation, those methods such as (1) and (2) below are considered to be particularly effective.

(1) A volume of ink to be discharged is reduced and a nozzle array pitch is narrowed, thereby to improve the resolution.

(2) With respect to particular color ink, a plurality of nozzle arrays are prepared for discharging, respectively, a plurality of (at least two) color inks that differ in ratio of a contained color material, i.e. in concentration of the color material, and the high-concentration ink and the low-concentration ink are selectively printed in an overlapping manner as required, thereby to improve gradation.

However, for obtaining the high-quality print image with high fineness and high gradation by reducing as much as possible a volume of each ink droplet to be discharged so as to realize the method (1), it is necessary to hit (place) more ink droplets on a recording medium with high accuracy and record them, and thus, nozzles for discharging ink droplets of the stable volume and hitting them on the recording medium with high accuracy as well as a high frequency response of an ink discharge head are required.

Further, for realizing the method (2), nozzle arrays for discharging high-concentration ink and low-concentration ink, respectively, are necessary with respect to particular color ink, so that a configuration of a print head becomes complicated. For discharging such small ink droplets from the nozzles, there has been proposed a print head of the type that causes bubbles growing due to film boiling following heating of ink to communicate with the air via nozzles, as disclosed in, for example, JP-A-04-10940, JP-A-04-10941, and JP-A-04-10742. For distinguishing it from the old bubble jet type that discharges ink droplets without causing bubbles growing due to film boiling to communicate with the air, it is sometimes called the bubble through type.

In the print head of the old bubble jet type that discharges ink droplets without causing bubbles growing due to film boiling to communicate with the air, as the size of an ink droplet discharged from a nozzle is reduced, it is necessary to reduce a sectional area of an ink flow passage communicating with the nozzle, so that there arises a disadvantage that the discharge efficiency is lowered to drop the discharge speed of the ink droplet discharged from the nozzle. If the discharge speed of the ink droplet is lowered, it is possible that a discharge direction thereof becomes unstable, and further, viscosity of the ink is increased following evaporation of moisture while the print head is stopped in operation, and thus the discharge state becomes further unstable to cause initial discharge failure and so on, thus leading to lowering of the reliability.

In contrast, in the print head of the bubble through type in which bubbles communicate with the air, the size of an ink droplet can be determined only from a geometrical shape of a nozzle. Therefore, there are advantages that it is suitable for discharging small ink droplets, it tends to be free of an influence such as temperatures, and the discharge amount of each ink droplet is very stable as compared with the print head of the old bubble jet type. Thus, it is possible to obtain the high-quality print image with high fineness and high gradation relatively easily.

For obtaining the high-quality print image with high fineness and high gradation, a print head configuration in combination of the foregoing methods (1) and (2) is considered to be particularly effective. For obtaining a print image at high speed, it is also effective to shorten a period for discharging ink, or form each recording pixel with ink of a large discharge volume, thereby suppressing the recording density. Therefore, if a discharge volume of low-concentration ink is set to be larger than a discharge volume of high-concentration ink with respect to particular color ink, and an image is recorded on a recording medium by combination of ink droplets of them, the total number of times of discharging ink and a period therefor can be suppressed, so that there can be realized an ink droplet discharge head that is energy saving and highly accurate. Accordingly, the high-quality print image with high fineness and high gradation can be obtained at high speed.

When carrying out printing by discharging an ink droplet of an extremely small amount from one nozzle, the bubble through type is particularly suitable in the ink jet printer as described above.

FIG. 9 shows a discharging state of ink droplets when the ink droplets are continuously discharged from all the nozzles while scan-moving the print head of the ink jet type together with a carriage along a print medium at high speed, thereby performing so-called solid printing relative to the print medium. The scan-moving direction of a print head 101 is perpendicular to the sheet of FIG. 9, and nozzles (not shown) are arrayed right and left in the figure. When image data is solid, all the discharge energy generating portions (not shown) corresponding to the respective nozzles are driven at high driving frequencies. Therefore, following motions of ink droplets 103 discharged from the nozzles toward a print medium 102, the ambient air having viscosity also moves induced by the motions of the ink droplets 103. As a result, the vicinity of a nozzle surface 104 where the nozzles of the print head 101 open tends to be reduced in pressure as compared with portions around the print head 101, so that the ambient air flows into the pressure-reduced region as air flows. It has been confirmed that, due to influence of the air flows, the ink droplets 103 discharged from the nozzles, particularly those nozzles located on both end sides in a nozzle array direction, are drawn toward the center in the nozzle array direction, so that the ink droplets 103 are not discharged to expected positions relative to the print medium 102. Accordingly, a plurality of discharged liquid droplets are drawn toward the center.

FIG. 10 exemplarily shows an image of solid printing that is formed on the print medium when the solid printing is carried out by a plurality of times of scanning movement of a carriage under such a phenomenon. The carriage is scan-moved along with the print head perpendicularly to the sheet of the figure. It is seen that a white stripe 107 is formed between a solid image 105 formed by the previous scanning movement and a solid image 106 formed by the subsequent scanning movement.

It has been found through study of the inventors that such a disadvantage occurs particularly notably in the ink jet printer of the bubble through type wherein the nozzle array pitch is set narrow and ink droplets each of a small amount of 10 pl or less can be discharged at a short period through one driving operation, and the degree of the disadvantage differs depending on a difference in volume of an ink droplet discharged. Table 1 shows data about an end mis-alignment amount (half value of white stripe 107) when the nozzle array pitch is 1200 dpi (21 $\mu$m).

TABLE 1

| Discharge Amount (pl) | End Mis-Alignment Amount ($\mu$m) |
|---|---|
| 2 | 3 or greater |
| 4 | 20 or greater |

The reason therefor is that since the ink droplets are continuously discharged from all the nozzles while scan-moving the print head together with the carriage along the print medium at high speed, various factors such as a shape and a scanning speed of the carriage, a position of the nozzle array, a distance between the nozzle and the print medium, and a size and a discharge speed of an ink droplet, are complexly entangled. Among these factors, what the present invention aims to solve is to prevent the degree of the end mis-alignment (disadvantage that a plurality of discharged liquid droplets at end portions are drawn toward the center) from differing depending on the size of ink droplets. Another is to perform the optimum correction of end mis-alignment amounts that influence each other due to coexistence of ink droplets having different sizes. For example, when a nozzle array discharging about 4 pl from each nozzle and a nozzle array discharging about 2 pl from each nozzle coexist and a carriage scans at high speed while causing both nozzle arrays to discharge simultaneously, ink droplets each of about 2 pl located on the downstream side of the nozzle array discharging ink droplets each of about 4 pl exhibit an end mis-alignment amount that is 1.5 to 3 times an end mis-alignment amount when discharged alone. Conventionally, it was possible to ease the foregoing disadvantage by suppressing the driving frequencies for the discharge energy generating portions, or by reducing the number of those portions to be driven while the carriage performs scanning once. However, if the driving frequencies for the discharge energy generating portions are lowered or the number of the driven portions is set small, the printing speed is lowered so that the users' demand for high-speed printing can not be satisfied.

SUMMARY OF THE INVENTION

Therefore, an object of the present invention is to provide a liquid discharge head that, even in an ink jet printer in which nozzle arrays having different ink discharge volumes coexist so that ink droplets having different sizes are discharged simultaneously, aims to prevent deviation of ink droplets discharged from nozzles located on both end sides in a nozzle array direction of each nozzle array, thereby to prevent occurrence of a white stripe upon solid printing, and further provide a head cartridge and an image forming apparatus using such a liquid discharge head.

For accomplishing the foregoing object, according to the present invention, there is provided a liquid discharge head having a plurality of nozzle arrays each provided with a plurality of nozzles and each arranged substantially in parallel to a print medium conveying direction, and a plurality of discharge energy generating portions for discharging liquid from the nozzles, respectively, the liquid discharge head moved to scan in a direction crossing the conveying direction, the liquid discharge head, wherein each of the nozzle arrays has a first nozzle group in which a pitch of the nozzles is set to a first pitch, and second nozzle groups arranged on both end sides of the corresponding nozzle array and each having at least a third nozzle group provided with the nozzles arranged at a second pitch greater than the first pitch, and the first pitch and the second pitch are set so as to differ depending on a volume of a liquid droplet to be discharged.

As described above, the nozzle array has the first nozzle group, and the second nozzle groups each having the third nozzle group, and the second pitch of the nozzles on both end sides of this nozzle array is set greater than the first pitch. With this configuration, such a state can be prevented individually per discharge volume that the vicinity of the nozzles tends to be reduced in pressure as compared with portions around the liquid discharge head, so that the ambient air flows into the pressure-reduced region as air flows and, due to influence of the air flows, the liquid discharged from the nozzles, particularly those nozzles located on both end sides in a nozzle array direction, are drawn toward the center in the nozzle array direction, hence, the liquid is not discharged to expected positions relative to the print medium.

Further, the pitches of the nozzles are configured to differ depending on the volume of the liquid droplet to be discharged. With this configuration, even if there coexist two or more kinds of volumes of liquid droplets to be discharged simultaneously, the respective nozzle pitches can be corrected by proper amounts.

It may be configured that a volume of a liquid droplet discharged from each of the nozzles arranged at the first pitch is smaller than a volume of a liquid droplet discharged from each of the nozzles arranged at the second pitch.

Further, it may be configured that each of the second nozzle groups includes only the third nozzle group that includes the nozzle located at an end of the nozzle array.

Further, it may be configured that each of the second nozzle groups includes a fourth nozzle group provided with the nozzles arranged at the first pitch and including the nozzle located at an end of the nozzle array.

Further, it may be configured that liquid to be discharged is recording ink selected from the group consisting of same-color ink, thick-color ink and light-color ink, and/or treatment liquid for adjusting a printing property of ink relative to a print medium.

Further, it may be configured that liquid to be discharged is recording ink, ink droplets to be discharged have two different volumes, a volume ratio of the two difference volumes is 1.5 to 3 times, an ink droplet having the larger volume has a lighter color, and an ink droplet having the larger volume is discharged from each of the nozzles set to the second pitch. Alternatively, the liquid to be discharged may be recording ink of the same color.

Further, it may be configured that each of the discharge energy generating portions has an electro-thermal converter that generates thermal energy for causing film boiling in liquid to discharge the liquid from the nozzles.

According to the present invention, there is provided another liquid discharge head having a plurality of nozzle arrays each provided with a plurality of nozzles and each arranged substantially in parallel to a print medium conveying direction, and a plurality of discharge energy generating portions for discharging liquid from the nozzles, respectively, the liquid discharge head moved to scan in a direction crossing the conveying direction, the liquid discharge head, wherein a volume of an ink droplet to be discharged from each of the nozzles differs per the nozzle array, a pitch of the nozzles arranged on both end sides of each of the nozzle arrays is greater than a pitch of the nozzles arranged at a center portion of the corresponding nozzle array, and the pitch of the nozzles arranged on both end sides of the nozzle array where a volume of an ink droplet is large, is greater than the pitch of the nozzles arranged on both end sides of the nozzle array where a volume of an ink droplet is small.

According to the present invention, a head cartridge is characterized by comprising the liquid discharge head of the present invention and a liquid tank storing liquid to be supplied to the liquid discharge head.

It may be configured that the liquid tank is detachable relative to the liquid discharge head via attaching/detaching means.

According to the present invention, an image forming apparatus is characterized by comprising a mounting portion for the liquid discharge head of the present invention, wherein an image is formed on a print medium using liquid discharged from nozzles of the liquid discharge head.

As described above, according to the image forming apparatus of the present invention, since an image is formed on the print medium by the liquid discharge head of the present invention, such a state can be prevented individually per discharge volume that the vicinity of the nozzles tends to be reduced in pressure as compared with portions around the liquid discharge head, so that the ambient air flows into the pressure-reduced region as air flows and, due to influence of the air flows, the liquid discharged from the nozzles, particularly those nozzles located on both end sides in a nozzle array direction, are drawn toward the center in the nozzle array direction, hence, the liquid is not discharged to expected positions relative to the print medium. Therefore, even if there coexist two or more kinds of volumes of liquid droplets that are simultaneously discharged, since respective nozzle pitches are corrected by proper amounts, a high-quality print image with high fineness and high gradation, which is free of occurrence of a white stripe even if solid printing is carried out, can be obtained.

It may be configured that the mounting portion has a carriage that is movable for scanning in a direction crossing a print medium conveying direction.

Further, it may be configured that the liquid discharge head is detachably mounted on the carriage via attaching/detaching means.

DESCRIPTION OF THE PREFERRED EMBODIMENTS

Now, preferred embodiments of the present invention will be described with reference to the accompanying drawings.

Numerical values shown in the following respective embodiments are only an example, and the present invention is not limited thereto. Further, the present invention is not limited to the respective embodiments, but may include combinations thereof, and is further applicable to other techniques to be contained in the concept of the present invention as defined in the appended claims.

(First Embodiment)

One preferred embodiment wherein an image forming apparatus according to the present invention is applied to an ink jet printer will be described in detail referring to FIGS. 1 to 9.

Figure 1:
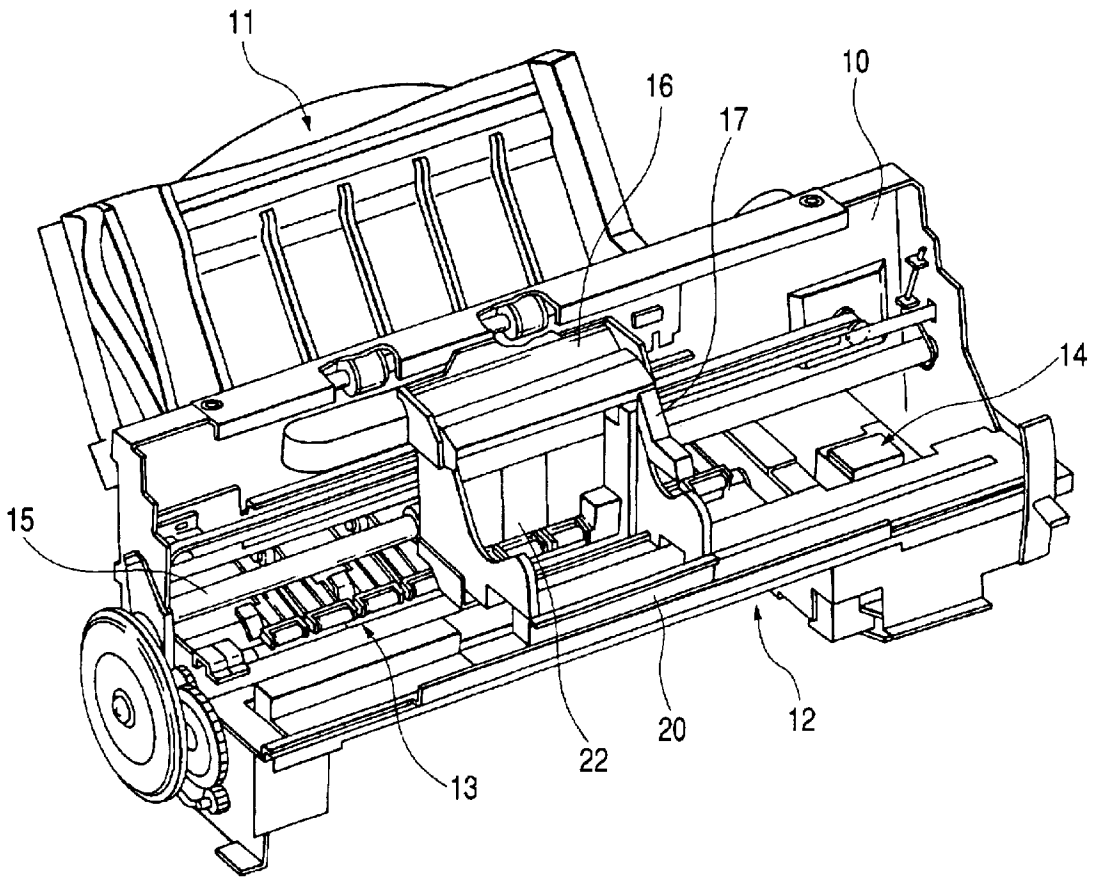
FIG. 1 is a perspective view showing a schematic configuration of one preferred embodiment wherein an image forming apparatus according to the present invention is applied to an ink jet printer.
Figure 2:
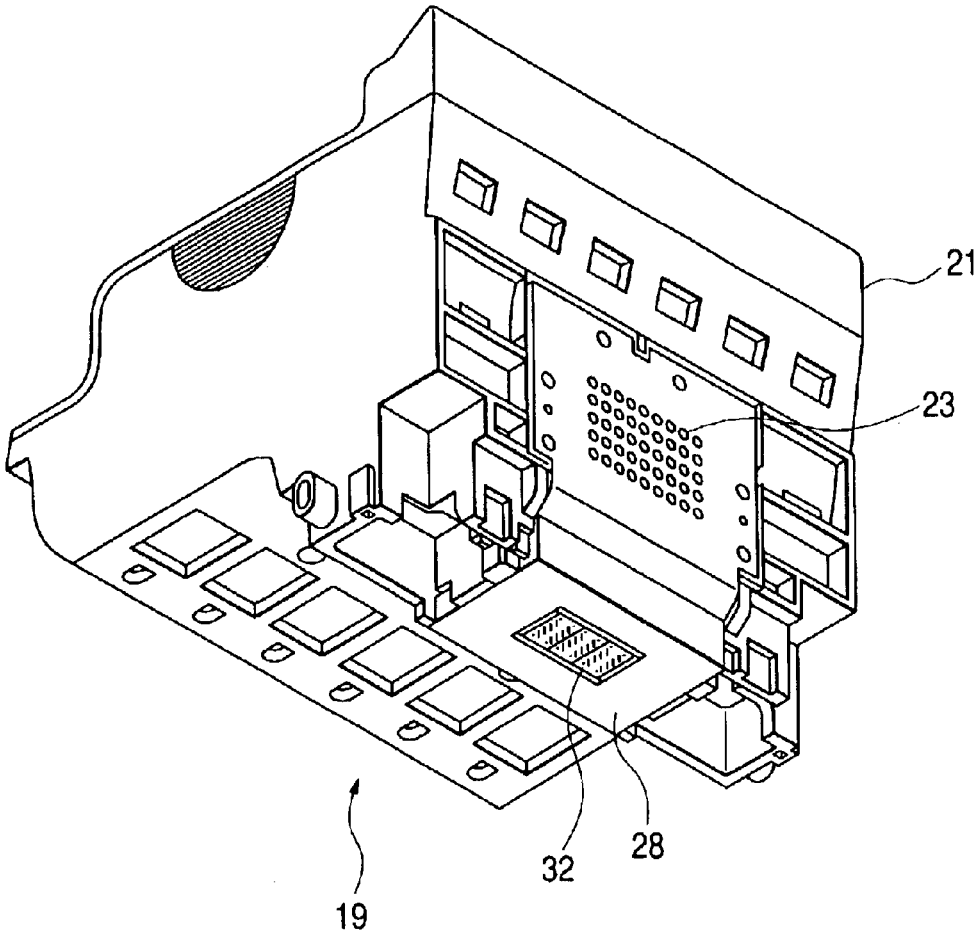
FIG. 2 is a perspective view showing an external appearance of one preferred embodiment in a disassembled state wherein a head cartridge according to the present invention is applied to the ink jet printer shown in FIG. 1.
Figure 3:
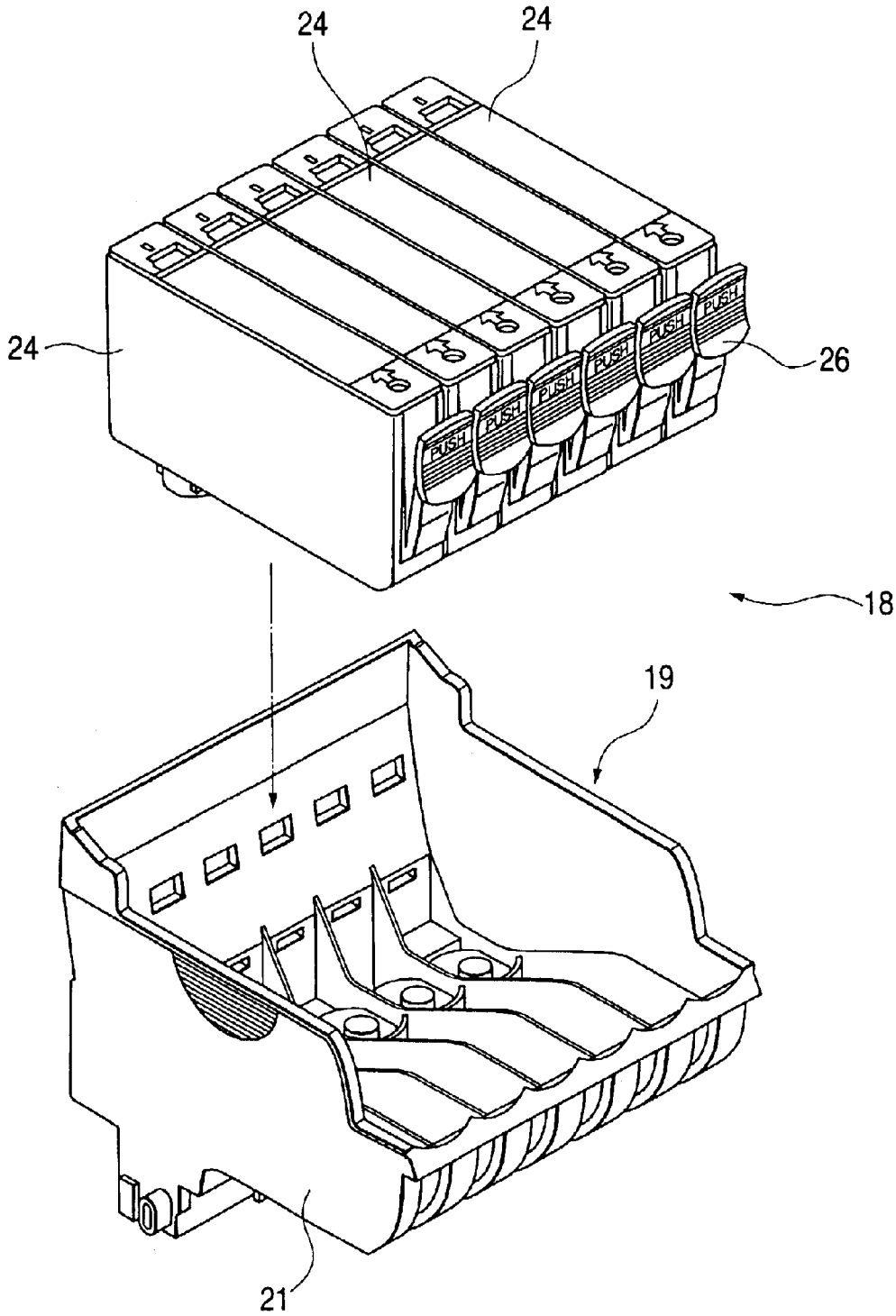
FIG. 3 is a perspective view of a print head in the head cartridge shown in FIG. 2.

An external appearance of a mechanical portion of the ink jet printer in this embodiment is shown in FIG. 1, an external appearance of a head cartridge used in this ink jet printer is shown in FIG. 2 in a disassembled state, and an external appearance of a print head thereof is shown in FIG. 3. Specifically, a chassis 10 of the ink jet printer in this embodiment is provided with a plurality of plate-shaped metal members having a prescribed rigidity, and forms a framework of the ink jet printer. On the chassis 10 are mounted a medium feed portion 11 for automatically feeding a print medium in the form of a sheet toward the inside of the ink jet printer, a medium conveying portion 13 for conveying a print medium fed one by one from the medium feed portion 11 to a given print position and further conveying the print medium to a medium discharge portion 12, a print portion for carrying out a prescribed printing operation relative to the print medium conveyed to the print position, and a head recovery portion 14 for carrying out a recovery process relative to the print portion.

The print portion comprises a carriage 16 that is supported movably along a carriage shaft 15 for scanning, and a head cartridge 18 detachably mounted onto the carriage 16 via a head set lever 17.

The carriage 16 to be mounted with the head cartridge 18 is provided with a carriage cover 20 for positioning a print head 19 of the head cartridge 18 in a prescribed mounting position on the carriage 16, and the foregoing head set lever 17 that engages with a tank holder 21 of the print head 19 and pushes it so as to place the print head 19 in the prescribed mounting position. The head set lever 17 is pivotally mounted on a head set lever shaft (not shown) at an upper portion of the carriage 16, and provided, at an engaging portion with the print head 19, with a head set plate (not shown) urged by a spring. By means of a spring force of the head-set plate, the head set lever 17 pushes the print head 19 thereby to mount it onto the carriage 16.

One end of a contact flexible print cable (hereinafter referred to as "contact FPC") 22 (not shown) is connected to another engaging portion, relative to the print head 19, of the carriage 16. A contact portion (not shown) formed at such one end of the contact FPC 22 and a contact portion 23, as external signal input terminals, provided in the print head 19 are brought into contact with each other so as to be electrically connected therebetween, so that exchanges of various information for printing, power feeding to the print head 19, and so on can be performed.

Between the contact portion of the contact FPC 22 and the carriage 16 is provided an elastic member such as rubber. By means of an elastic force of this elastic member and a pushing force of the head set plate, the contact portion of the contact FPC 22 and the contact portion 23 of the print head 19 can be securely contacted therebetween. Another end of the contact FPC 22 is connected to a carriage substrate (not shown) mounted at the back of the carriage 16.

The head cartridge 18 in this embodiment comprises ink tanks 24 storing ink, and the foregoing print head 19 for discharging ink, supplied from the ink tanks 24, through nozzles 25 (see FIG. 4) of the print head 19 according to print information. The print head 19 in this embodiment employs the so-called cartridge type wherein the print head 19 is detachably mounted onto the carriage 16.

In this embodiment, for enabling high-quality photographic color printing, the independent six ink tanks 24 can be used for the colors of, for example, black, light cyan, light magenta, cyan, magenta, and yellow, respectively. Each ink tank 24 is provided with an elastically deformable removing lever 26 that is retainable relative to the head cartridge 18. By operating this removing lever 26, each ink tank 24 is detachable relative to the print head 19 as shown in FIG. 3.

Figure 4:
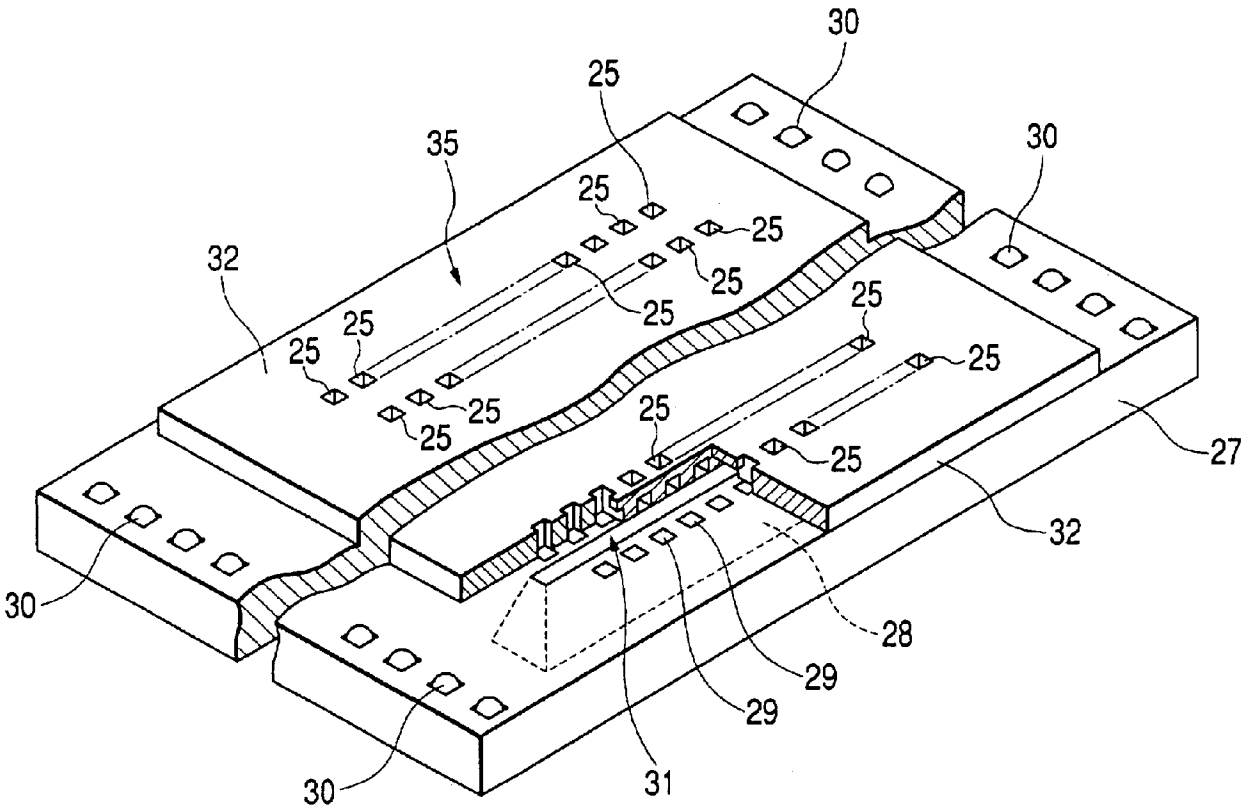
FIG. 4 is a cutaway perspective view showing a schematic configuration of the main part of the print head shown in FIG. 3.
Figure 5B:
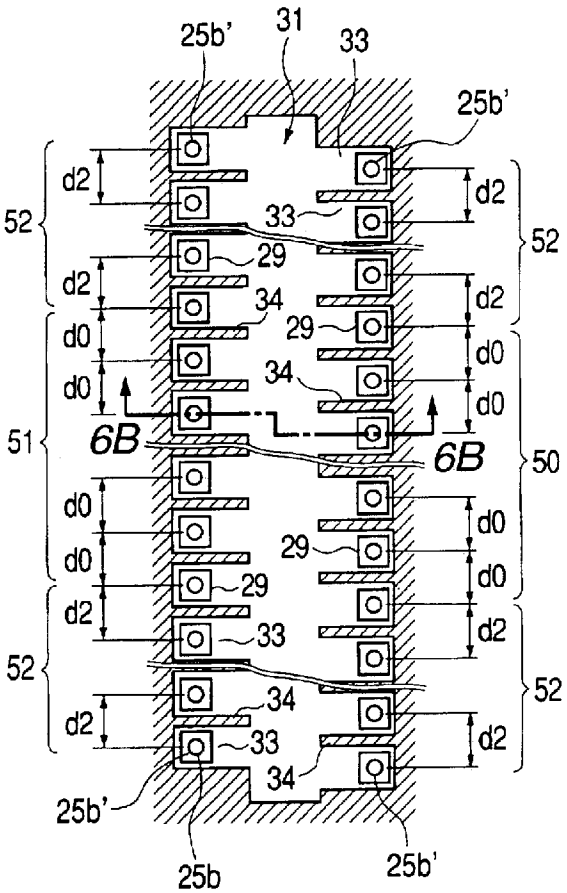
FIGS. 5A and 5B are cutaway plan views respectively showing a first and a second array state of nozzles and electro-thermal converters of a print head according to a first preferred embodiment of the present invention.
Figure 5A:
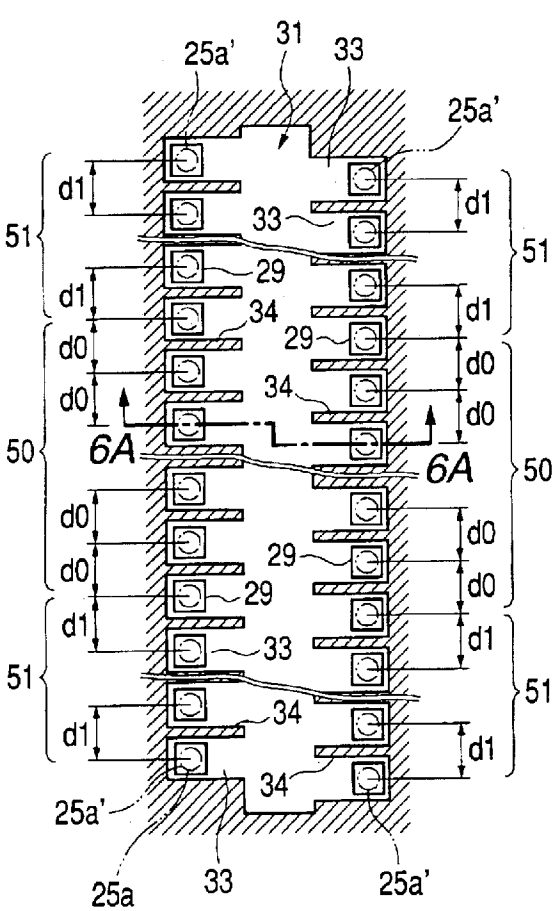
Figure 6A:
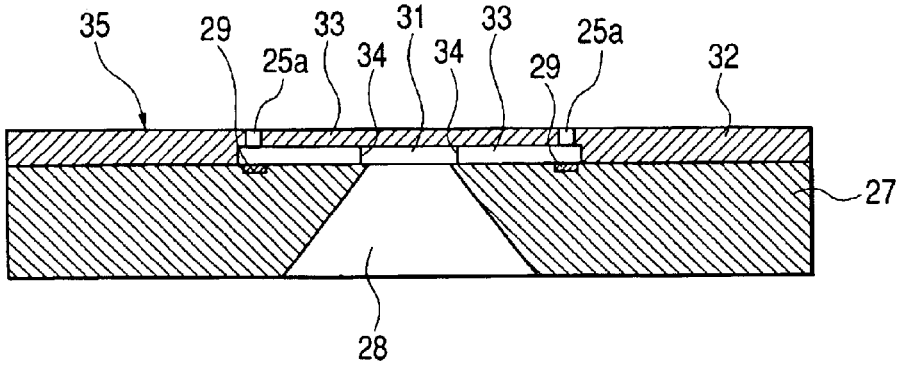
FIGS. 6A and 6B are sectional views taken along line 6A—6A in FIG. 5A and along line 6B—6B in FIG. 5B, respectively.
Figure 6B:
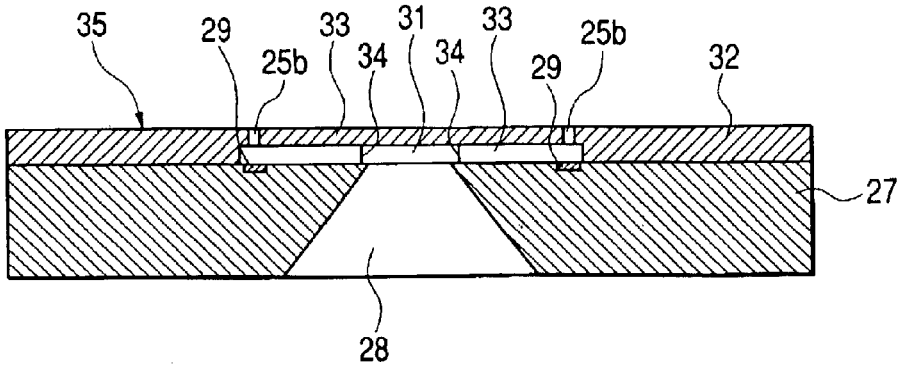
Figure 7B:
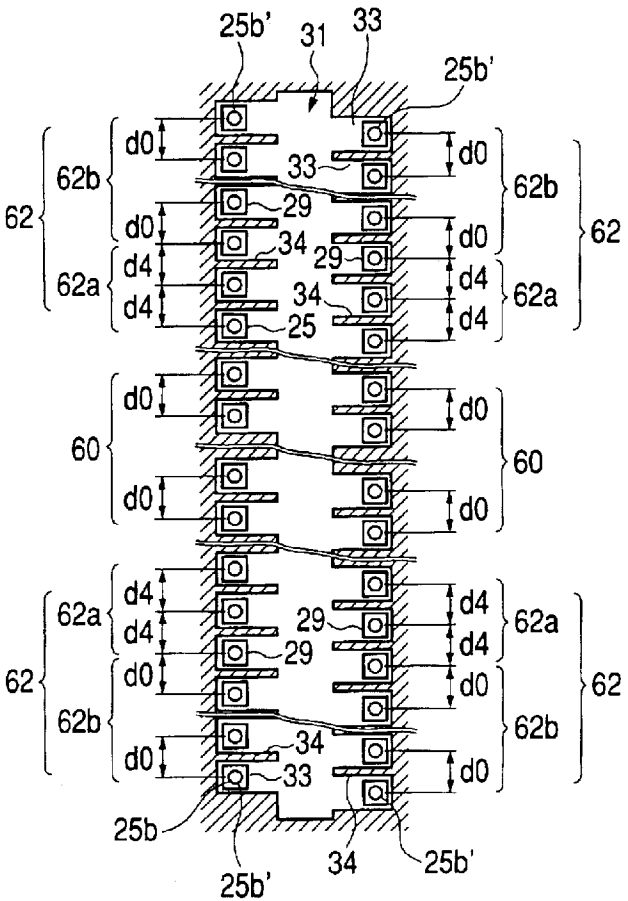
FIGS. 7A and 7B are cutaway plan views respectively showing a third and a fourth array state of nozzles and electro-thermal converters of a print head according to a second preferred embodiment of the present invention.
Figure 7A:
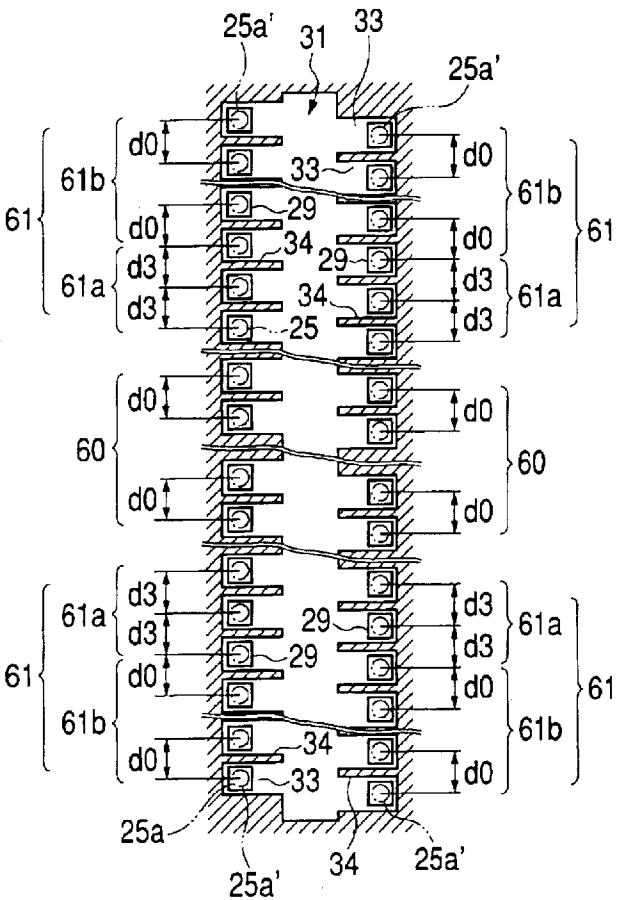

The print head 19 comprises a later-described print element substrate 27, the foregoing tank holder 21, and so on. FIG. 4 shows a cutaway configuration of the print element substrate 27 of the print head 19 in this embodiment, FIGS. 5A and 5B show nozzle array states of the print element substrate 27, respectively, and FIGS. 6A and 6B show a 6A—6A sectional configuration of FIGS. 5A and a 6B—6B sectional configuration of FIG. 5B, respectively. The print element substrate 27 in this embodiment is in the form of a silicon substrate having a thickness of 0.5 mm to 1 mm, on which discharge energy generating portions, common ink chambers 31, ink passages 33, nozzles 25, and so on are formed using a film formation technique. Specifically, the print element substrate 27 is formed with ink supply ports 28 each in the form of an elongate hole penetrating the print element substrate 27. On both sides of the ink supply port 28, a plurality of electro-thermal converters 29 are formed in two lines each extending along a print medium conveying direction, i.e. along a longitudinal direction of the ink supply port 28. The electro-thermal converters 29 are arranged with a predetermined pitch in each line, and offset by a half pitch between the respective two lines. The electro-thermal converters 29 in each line form a discharge energy generating portion. A distance between the centers of the two lines is 233 $\mu$m. In this embodiment, the number of the electro-thermal converters 29 in each is 256. Apart from the electro-thermal converters 29, the print element substrate 27 is formed with electrode terminals 30 for electrical connection between the electro-thermal converters 29 and the side of a printer body, electrical wiring (not shown) made of aluminum or the like, and so on, using a film formation technique.

An electrical wiring substrate 36 connected to the electrode terminals 30 formed on the print element substrate 27 is for applying electrical signals for discharging ink, to the print element substrate 27. The electrical wiring substrate 36 has electrical wiring corresponding to the print element substrate 27, and the foregoing contact portion 23 located at an end portion of such electrical wiring for receiving electrical signals from the printer body. The contact portion 23 is fixed on the back side of the tank holder 21. A driving signal is given to the electro-thermal converter 29 from a driving IC (not shown) via the electrical wiring substrate 36, and simultaneously, driving power is fed to that electro-thermal converter 29.

The tank holder 21 detachably holding the ink tanks 24 is formed with ink flow passages extending from the ink tanks 24 to the corresponding ink supply ports 28 of the print element substrate 27.

On the print element substrate 27, an upper plate member 32 is formed that has the terminals 25 confronting the electro-thermal converters 29, respectively, via each of the common ink chambers 31 communicating with the corresponding ink supply ports 28. Specifically, the ink passages 33 each establishing communication between the corresponding nozzle 25 and the common ink chamber 31 are formed between the upper plate member 32 and the print element substrate 27, and partition walls 34 are formed between the adjacent ink passages 33. The common ink chambers 31, the ink passages 33, the partition walls 34, and so on are formed along with the upper plate member 32, like the nozzles 25, using a photolithography technique.

Liquid supplied from the ink supply port 28 into each ink passage 33 boils following heat generation of the electro-thermal converter 29 exposed to the corresponding ink passage 33 when a driving signal is given to such an electro-thermal converter 29, and is discharged from the corresponding nozzle 25 due to a pressure of a bubble generated thereupon. In this event, a bubble generated in the liquid chamber 31 is, following growth thereof, brought into the state communicating with the air.

In this embodiment, the print head is configured such that there coexist two kinds of nozzle arrays in a first array state shown in FIG. 5A and a second array state shown in FIG. 5B.

The print head shown in FIGS. 5A and 5B has a nozzle array provided with first nozzles 25*a* shown in FIG. 5A, and a nozzle array provided with second nozzles 25*b* shown in FIG. 5B, wherein a diameter of the second nozzle 25*b* is smaller than that of the first nozzle 25*a*.

The first array state has a first nozzle group 50 provided with the first nozzles 25*a* arranged at an array pitch $d_0$, and second nozzle groups 51 each provided with the first nozzles 25*a* arranged at an array pitch $d_1$. The second nozzle groups 51 are disposed on both sides of the nozzle array, and the first nozzle group 50 is disposed therebetween.

Specifically, in the first array state, each of the second nozzle groups 51 includes 20 nozzles in each line counted from the end nozzle 25*a*', wherein the array pitch $d_1$ is set to 43.3 μm that is greater than a pitch of 600 dpi by lam. Further, between the second nozzle groups 51 arranged on both end sides, the first nozzle group 50 whose array pitch do is set to 600 dpi (42.3 μm) is arranged. Therefore, each end nozzle 25*a*' arranged at an end in a nozzle array direction is dislocated by 20 μm in a direction in which the pitch increases, as compared with the case where all the nozzles are arranged at the pitch of 600 dpi. Further, the first nozzles 25*a* in one line are arranged with an offset of a half of the array pitch of the first nozzles 25*a* in the other line, and thus, a combined array density of the first nozzles 25*a* in two lines becomes approximately 1200 dpi.

On the other hand, the second array state has a first nozzle group 50 provided with the second nozzles 25*b* arranged at the array pitch $d_0$, and second nozzle groups 52 each provided with the second nozzles 25*b* arranged at an array pitch $d_2$. The second nozzle groups 52 are disposed on both sides of the nozzle array, and the first nozzle group 50 is disposed therebetween.

Specifically, in the second array state, each of the second nozzle groups 52 includes 20 nozzles in each line counted from the end nozzle 25*b*', wherein the array pitch $d_2$ is set to 42.55 μm that is greater than a pitch of 600 dpi by 0.25 μm. Further, between the second nozzle groups 52 arranged on both end sides, the first nozzle group 50 whose array pitch $d_0$ is set to 600 dpi (42.3 μm) is arranged. Therefore, each end nozzle 25*b*' arranged at an end in a nozzle array direction is dislocated by 5 μm in a direction in which the pitch increases, as compared with the case where all the nozzles are arranged at the pitch of 600 dpi. Further, the second nozzles 25*b* in one line are arranged with an offset of a half of the array pitch of the second nozzles 25*b* in the other line, and thus, a combined array density of the second nozzles 25*b* in two lines becomes approximately 1200 dpi.

In this embodiment, an interval between the foregoing two nozzle arrays (distance between the center of the first nozzle 25*a* in the right line in FIG. 5A and the center of the corresponding second nozzle 25*b* in the left line in FIG. 5B) is set to 23 μm. In the first array state, each of the electro-thermal converters 29 arranged therein has a square shape with one side being 24 μm, each of the first nozzles 25*a* arranged therein has a circular shape with a diameter of 14 μm, and an ink droplet of about 4 pl is discharged. On the other hand, in the second array state, each of the electro-thermal converters 29 arranged therein has a square shape with one side being 22 μm, each of the second nozzles 25*b* arranged therein has a circular shape with a diameter of 12 μm, and an ink droplet of about 2 pl is discharged. The discharge speed is set to 10 to 15 m/s.

Each of the first and second nozzles 25*a* and 25*b* may have a shape other than a circle as in this embodiment. Even if the nozzle has, for example, a rectangular shape or a star shape, there will be raised no particular problem.

Further, in this embodiment, the ink droplet volume ratio is set to about twice as an example. However, it may be set to a value within a range of 1.5 to 3 times. Further, with respect to the colors of ink, the same-color ink, the thick-color ink and the light-color ink may be used in any combination thereof depending on a volume of an ink droplet to be discharged. However, it is desirable to use the light-color ink when the volume of an ink droplet to be discharged is large. Further, as liquid to be discharged, not only ink, but also treatment liquid for adjusting a printing property of ink relative to a print medium, may be used.

While scan-moving the thus configured print head 19 of the ink jet type together with the carriage 16 at high speed along the print medium, ink droplets were continuously discharged from all the nozzles 25 to carry out the so-called solid printing relative to the print medium.

Upon performing photographic recording, a multi-pass operation is used wherein an image is formed in a plurality of passes. In this embodiment, recording was carried out in four passes. CANON PR-101 paper was used as media, and widths of blurs were measured. Further, for comparison, widths of blurs were also measured with respect to the conventional print head.

Figure 10:
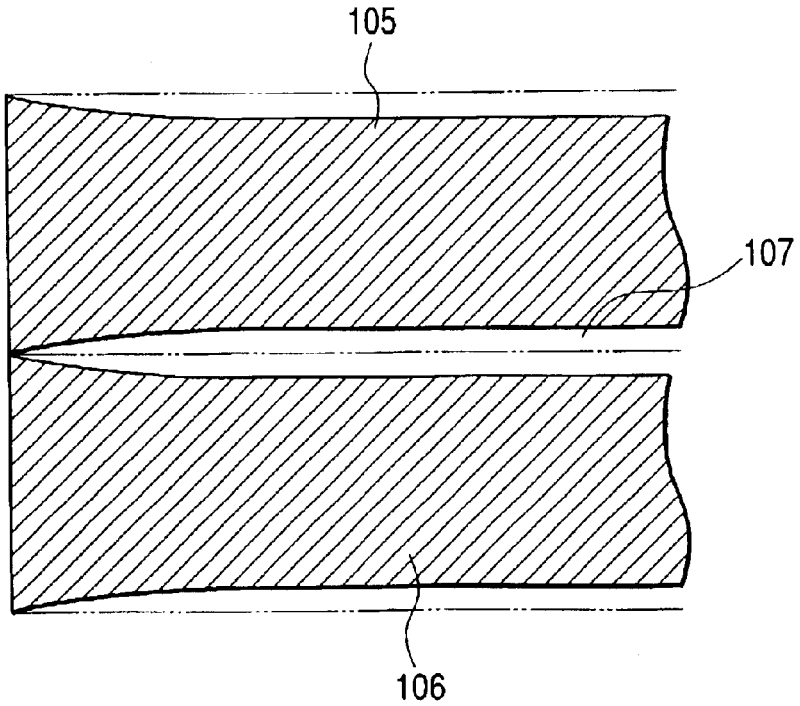
FIG. 10 is a conceptual diagram exemplarily showing a solid image that is formed on a print medium in one pass according to the ink discharging state shown in FIG. 9.
Figure 11:
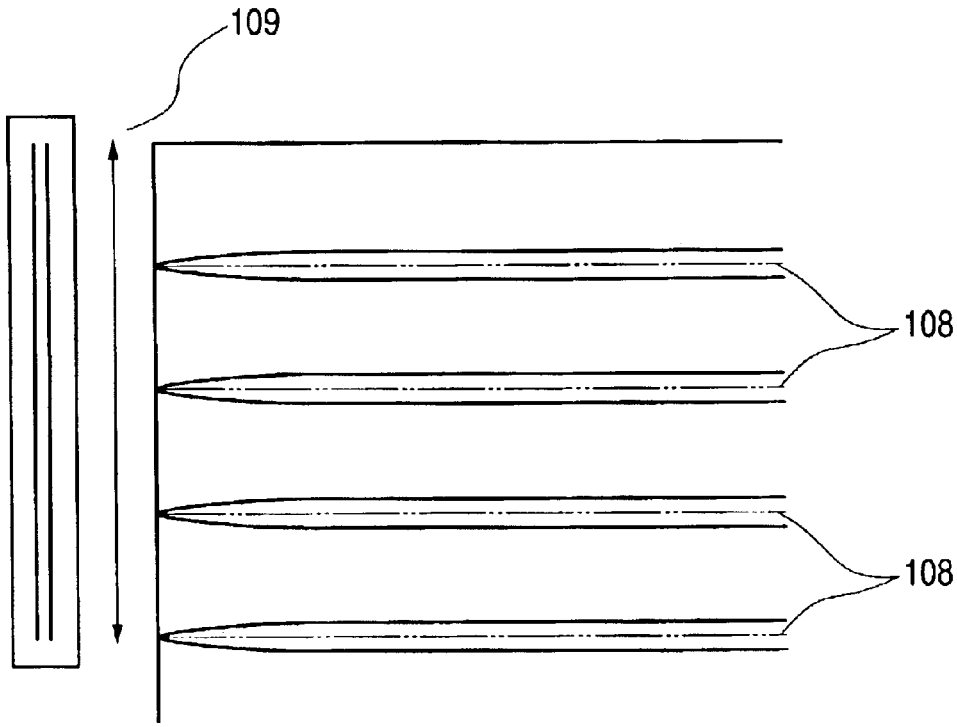
FIG. 11 is a conceptual diagram exemplarily showing a solid image that is formed on a print medium in four passes according to the ink discharging state shown in FIG. 9.

In case of the conventional print head wherein the nozzle pitch was set to 600 dpi only and no others, it was confirmed that the width of a white stripe 107 as shown in FIG. 10 reached as long as about 70 μm in the first array state. On the other hand, in case of photographic recording, transition portions 108 between passes became faint as shown in FIG. 11 and were seen as blurs.

On the other hand, in case of the print head of this embodiment, the width of a white stripe 107 was about 40 μm in the first array state and about 6 μm in the second array state.

When ink droplets each of about 4 pl and ink droplets each of about 2 pl are discharged simultaneously from the nozzle array in the first array state and the nozzle array in the second array state, respectively, the ink droplets each of about 2 pl located on the downstream side of the nozzle array discharging the ink droplets each of about 4 pl exhibit an end mis-alignment amount (5 to 8 μm) that is 1.5 to 3 times an end mis-alignment amount when discharged alone. Data is shown in Table 2, wherein 100% corresponds to solid recording over a nozzle width 109, and the 4-pass maximum duty corresponds to 25%.

TABLE 2

| Recording Duty (%) | 4 pl End Mis-Alignment (μm) | 2 pl End Mis-Alignment (μm) Only 2 pl Nozzle Array Discharged | 2 pl End Mis-Alignment (μm) 4/2 pl Both Nozzle Arrays Discharged |
|---|---|---|---|
| 100 | 35 | 15 | — |
| 50 | 25 | 10 | — |
| 25 | 18 | 3 | 5 to 8 |
| 12.5 | 8 | — | — |

From the data shown in Table 2, in this embodiment, taking into consideration of the case wherein ink droplets each of about 4 pl and ink droplets each of about 2 pl are discharged simultaneously from the nozzle array in the first array state and the nozzle array in the second array state, respectively, the 40 nozzles arranged in each line at both end portions in the nozzle array direction are dislocated each by 1 μm in the first array state and each by 0.25 μm in the second array state relative to the nozzle array pitch at the center portion in the direction in which the pitch is increased. As a result, due to a pressure-reduced atmosphere that is generated at the center portion in the nozzle array direction upon photographic print recording, ink droplets discharged from those nozzles located at both end portions in the nozzle array direction are drawn toward the center portion in the nozzle array direction, so that an interval between those ink droplets are finally corrected to be approximately equal to an interval of ink droplets that are discharged from the nozzles located at the center portion in the nozzle array direction and have reached the print medium. Therefore, occurrence of a white stripe or the like that is conventionally caused per scan-movement of the carriage 16, can be prevented in advance.

Upon carrying out such photographic printing, an interval between the print medium and a nozzle surface 35 where the first and second nozzles 25*a* and 25*b* of the print head 19 open, was set to 1.6 mm, and the scan-moving speed of the carriage 16 was set to 422.3 mm/s, whereupon, the response frequency of the nozzles of the print head was 20 kHz.

(Second Embodiment)

In the foregoing first embodiment, as shown in FIGS. 5A and 5B, the feature thereof resides in the configuration that the interval of the nozzles and the electro-thermal converters located at both end portions in the nozzle array direction is set greater than the interval of the others located at the center portion. On the other hand, in this embodiment, a print head is configured such that there coexist two kinds of nozzle arrays having different discharge volumes and having configurations like a third array state shown in FIG. 7A and like a fourth array state shown in FIG. 7B. Those elements having the same functions as those in the foregoing embodiment are assigned the same reference symbols, thereby to omit duplicate explanation thereof.

In the third array state, first nozzles 25*a* are arranged. The third array state has a first nozzle group 60 provided with the first nozzles 25*a* arranged at an array pitch $d_0$, and second nozzle groups 61 each including a third nozzle group 61*a* provided with the first nozzles 25*a* arranged at an array pitch $d_3$ and a fourth nozzle group 61*b* provided with the first nozzles 25*a* arranged at the array pitch $d_0$. The second nozzle groups 61 are disposed on both sides of the nozzle array, and the first nozzle group 60 is disposed therebetween.

Specifically, the array pitch $d_0$ of the first nozzles 25*a* and the discharge energy generating portions located in the first nozzle group 60 and the array pitch $d_0$ of them located in the fourth nozzle groups 61*b* are set to the same value, and the array pitch $d_3$ of the first nozzles 25*a* and the discharge energy generating portions arranged in each third nozzle group 61*a* located between the first nozzle group 60 and the fourth nozzle group 61*b* is set greater than the array pitch $d_0$ and differs depending on a volume of an ink droplet to be discharged.

More specifically, in the third array state, the array pitch $d_0$ of each of the fourth nozzle groups 61*a* including 4 nozzles in each line counted from the end nozzle 25*a*' and the first nozzle group 60 is set to 600 dpi (42.3 μm). On the other hand, the array pitch $d_3$ of the 20 first nozzles 25*a* and the 20 discharge energy generating portions located in each of the third nozzle groups 61*a* is set to 43.3 μm that is greater than a pitch of 600 dpi by 1 μm. Therefore, each end nozzle 25*a*' arranged at an end in a nozzle array direction is dislocated by 20 μm in a direction in which the pitch increases, as compared with the case where all the first nozzles 25*a* are arranged at the pitch of 600 dpi. Further, the first nozzles 25*a* in one line are arranged with an offset of a half of the array pitch of the first nozzles 25*a* in the other line, and thus, a combined array density of the first nozzles 25*a* in two lines becomes approximately 1200 dpi.

In the fourth array state, second nozzles 25*b* are arranged. The fourth array state has a first nozzle group 60 provided with the second nozzles 25*b* arranged at the array pitch $d_0$, and second nozzle groups 62 each including a third nozzle group 62*a* provided with the second nozzles 25*b* arranged at an array pitch $d_4$ and a fourth nozzle group 62*b* provided with the second nozzles 25*b* arranged at the array pitch $d_0$. The second nozzle groups 62 are disposed on both sides of the nozzle array, and the first nozzle group 60 is disposed therebetween.

Specifically, the array pitch $d_0$ of the second nozzles 25*b* and the discharge energy generating portions located in the first nozzle group 60 and the array pitch $d_0$ of them located in the fourth nozzle groups 62*b* are set to the same value, and the array pitch $d_4$ of the second nozzles 25*b* and the discharge energy generating portions arranged in each third nozzle group 62*a* located between the first nozzle group 60 and the fourth nozzle group 62*b* is set greater than the array pitch $d_0$.

More specifically, in the fourth array state, the array pitch $d_0$ of each of the fourth nozzle groups 62*a* including 4 nozzles in each line counted from the end nozzle 25*b*' and the first nozzle group 60 is set to 600 dpi (42.3 μm). On the other hand, the array pitch $d_4$ of the 20 second nozzles 25*b* and the 20 discharge energy generating portions located in each of the third nozzle groups 62*a* is set to 42.55 μm that is greater than a pitch of 600 dpi by 0.25 μm. Therefore, each end nozzle 25*b*' arranged at an end in a nozzle array direction is dislocated by 5 μm in a direction in which the pitch increases, as compared with the case where all the second nozzles 25*b* are arranged at the pitch of 600 dpi. Further, the second nozzles 25*b* in one line are arranged with an offset of a half of the array pitch of the second nozzles 25*b* in the other line, and thus, a combined array density of the second nozzles 25*b* in two lines becomes approximately 1200 dpi.

In this embodiment, a diameter of the nozzles up to the fourth nozzle counted from both ends of each line in the nozzle array direction is set to a relatively large value of 15 μm. Description about the other configuration is omitted to avoid duplicate description of the first embodiment. In this embodiment, like effects can be achieved as those in the first embodiment.

(Third Embodiment)

Figure 8:
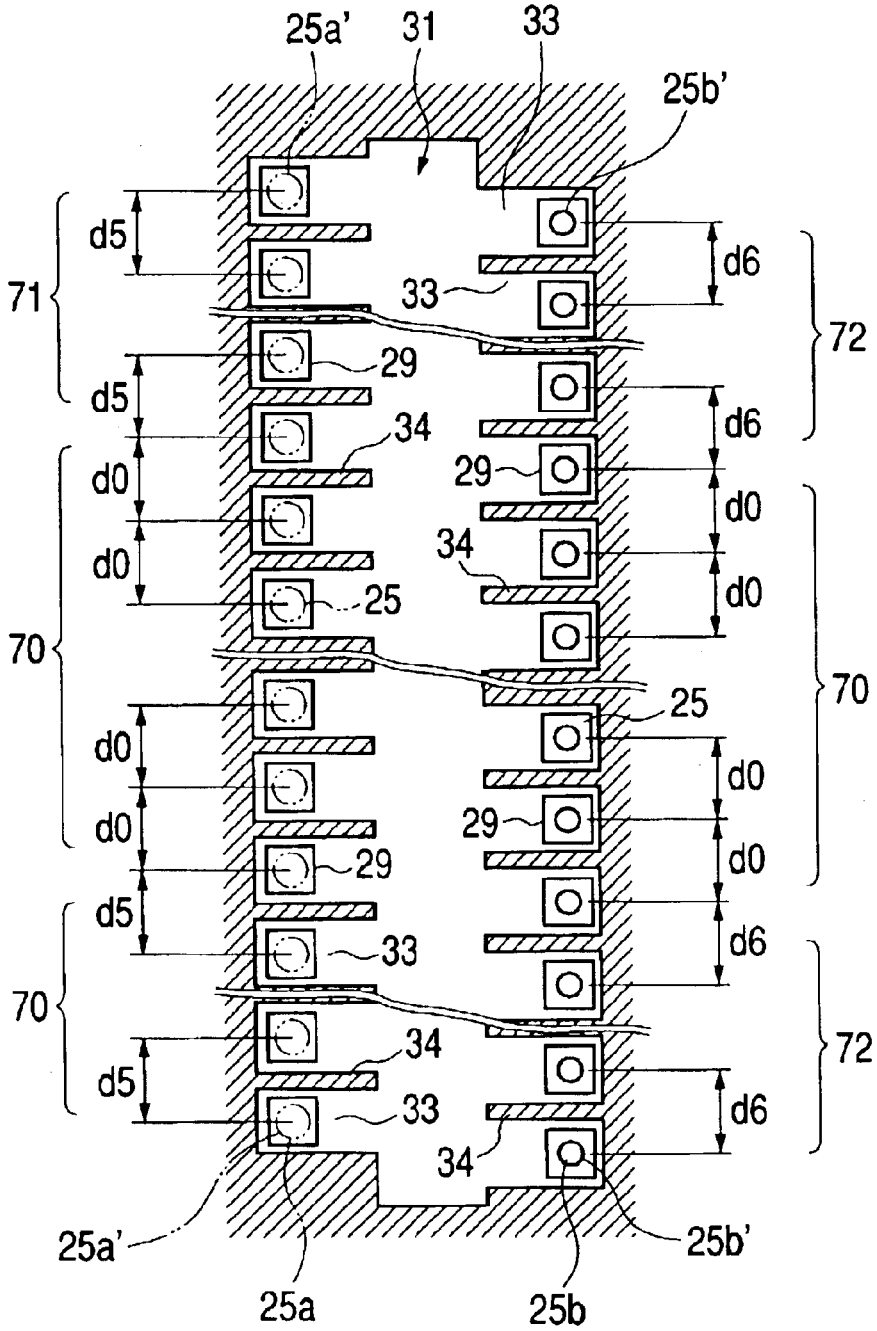
FIG. 8 is a cutaway plan view showing a fifth array state of nozzles and electro-thermal converters of a print head according to a third preferred embodiment of the present invention.
Figure 9:
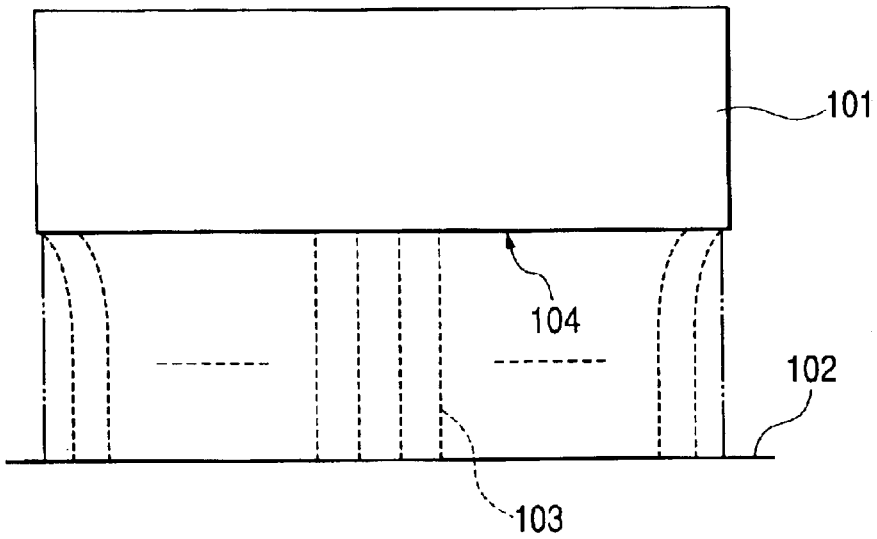
FIG. 9 is a conceptual diagram exemplarily showing a discharging state of ink according to a conventional ink jet printer.

In the foregoing first and second embodiments, the shapes and dimensions of the first and second nozzles 25*a* and 25*b* arranged in two lines (in the first embodiment, the number of the nozzles is 256 in each line and thus 512 in total) at predetermined pitches along the longitudinal direction on both sides of the common ink chamber 31 communicating with the ink supply port 28, are configured such that volumes of liquid droplets discharged therefrom become equal to each other. On the other hand, in this embodiment, as shown in FIG. 8, a feature resides in configuration that a volume of a liquid droplet discharged from each of first nozzles 25*a* arranged on one side of the common ink chamber 31 that can store the same-color ink, differs from a volume of a liquid droplet discharged from each of second nozzles 25*b* arranged on the other side.

In the fifth array state, one line has a first nozzle group 70 provided with the first nozzles 25*a* arranged at an array pitch $d_0$ and second nozzle groups 71 each provided with the first nozzles 25*a* arranged at an array pitch $d_5$. The second nozzle groups 71 are disposed on both sides of the nozzle array, and the first nozzle group 70 is disposed therebetween. The other line has a first nozzle group 70 provided with the second nozzles 25*b* arranged at the array pitch do and second nozzle groups 72 each provided with the second nozzles 25*b* arranged at an array pitch $d_6$. The second nozzle groups 72 are disposed on both sides of the nozzle array, and the first nozzle group 70 is disposed therebetween.

Specifically, in the fifth array state, each of the second nozzle groups 71 includes 20 nozzles in one line counted from the end nozzle 25*a*', wherein the array pitch $d_5$ is set to 43.3 μm that is greater than a pitch of 600 dpi by 1 μm. Further, between the second nozzle groups 71 arranged on both end sides, the first nozzle group 70 whose array pitch do is set to 600 dpi (42.3 μm) is arranged. Therefore, each end nozzle 25*a*' arranged at an end in a nozzle array direction is dislocated by 20 μm in a direction in which the pitch increases, as compared with the case where all the first nozzles 25*a* are arranged at the pitch of 600 dpi. On the other hand, each of the second nozzle groups 72 includes 20 nozzles in the other line counted from the end nozzle 25*b*', wherein the array pitch $d_6$ is set to 42.55 μm that is greater than the pitch of 600 dpi by 0.25 μm. Further, between the second nozzle groups 72 arranged on both end sides, the first nozzle group 70 whose array pitch $d_0$ is set to 600 dpi (42.3 μm) is arranged. Therefore, each end nozzle 25*b*' arranged at an end in a nozzle array direction is dislocated by 5 μm in a direction in which the pitch increases, as compared with the case where all the second nozzles 25*b* are arranged at the pitch of 600 dpi. Further, the second nozzles 25*b* in the other line are arranged with an offset of a half of the array pitch of the first nozzles 25*a* in one line, and thus, a combined array density of the first and second nozzles 25*a* and 25*b* in two lines becomes approximately 1200 dpi.

In this embodiment, the volume of a liquid droplet discharged from each of the first nozzles 25*a* in one line along the common ink chamber 31 is about 5 pl. Each of the electro-thermal converters 29 has a square shape with one side being 26 μm, and each of the first nozzles 25*a* has a circular shape with a diameter of 16 μm. On the other hand, the volume of a liquid droplet discharged from each of the second nozzles 25*b* arranged in the other line is about 2 pl. Each of the electro-thermal converters 29 has a square shape with one side being 22 μm, and each of the second nozzles 25*b* has a circular shape with a diameter of 12 μm. The discharge speed is set to 10 to 15 m/s in each line.

Each of the first and second nozzles 25*a* and 25*b* may have a shape other than a circle as in this embodiment. Even if the nozzle has, for example, a rectangular shape or a star shape, there will be raised no particular problem.

As described above, by using the print head that can discharge ink droplets of large and small sizes, the large ink droplets are used to form pixels so that a print image can be obtained at high speed by suppressing the recording density, while the small ink droplets are used to form pixels so that a high-quality print image with high fineness and high gradation can be obtained by increasing the recording density.

When any of the print heads in the first to third embodiments is used to carry out solid printing, the nozzles arranged at both end portions in the nozzle array direction are dislocated relative to the array pitch of the nozzles at the center portion in the direction in which the pitch increases, and further, the amount of dislocation differs depending on a volume of liquid to be discharged. As a result, due to a pressure-reduced atmosphere that is generated at the center portion in the nozzle array direction, ink droplets discharged from those nozzles located at both end portions in the nozzle array direction are drawn toward the center portion in the nozzle array direction, so that an interval between those ink droplets are finally corrected to be approximately equal to an interval of ink droplets that are discharged from the nozzles located at the center portion in the nozzle array direction and have reached the print medium. Therefore, in the print head wherein there coexist those nozzles that discharge liquid droplets of different volumes, occurrence of a white stripe or the like that is conventionally caused per scan-movement of the carriage, can be prevented in advance.

What is claimed is:

1. A liquid discharge head comprising:

a plurality of nozzle arrays each provided with a plurality of nozzles and each arranged substantially in parallel to a print medium conveying direction;

and a plurality of discharge energy generating portions for discharging liquid from said nozzles, respectively, said liquid discharge head moved to scan in a direction crossing said conveying direction, said liquid discharge head;

wherein each of said nozzle arrays has a first nozzle group in which a pitch of said nozzles is set to a first pitch, and second nozzle groups arranged on both end sides of the corresponding nozzle array and each having at least a third nozzle group provided with said nozzles arranged at a second pitch greater than said first pitch, and said first pitch and said second pitch are set so as to differ depending on a volume of a liquid droplet to be discharged.

2. A liquid discharge head according to claim 1, wherein a volume of a liquid droplet discharged from each of said nozzles arranged at said first pitch is smaller than a volume of a liquid droplet discharged from each of said nozzles arranged at said second pitch.

3. A liquid discharge head according to claim 1, wherein each of said second nozzle groups includes only said third nozzle group that includes the nozzle located at an end of said nozzle array.

4. A liquid discharge head according to claim 1, wherein each of said second nozzle groups includes a fourth nozzle group provided with said nozzles arranged at said first pitch and including the nozzle located at an end of said nozzle array.

5. A liquid discharge head according to claim 1, wherein liquid to be discharged is recording ink selected from the group consisting of same-color ink, thick-color ink and light-color ink, and/or treatment liquid for adjusting a printing property of ink relative to a print medium.

6. A liquid discharge head according to claim 1, wherein liquid to be discharged is recording ink, ink droplets to be discharged have two different volumes, a volume ratio of said two difference volumes is 1.5 to 3 times, an ink droplet having the larger volume has a lighter color, and an ink droplet having the larger volume is discharged from each of said nozzles set to said second pitch.

7. A liquid discharge head according to claim 1, wherein liquid to be discharged is recording ink of the same color, ink droplets to be discharged have two different volumes, a volume ratio of said two difference volumes is 1.5 to 3 times, and an ink droplet having the larger volume is discharged from each of said nozzles set to said second pitch.

8. A liquid discharge head according to claim 1, wherein each of said discharge energy generating portions has an electro-thermal converter that generates thermal energy for causing film boiling in liquid to discharge the liquid from said nozzles.

9. An image forming apparatus comprising a mounting portion for the liquid discharge head according to claim 1, wherein an image is formed on a print medium using liquid discharged from nozzles of said liquid discharge head.

10. An image forming apparatus according to claim 9, wherein said mounting portion has a carriage that is movable for scanning in a direction crossing a print medium conveying direction.

11. An image forming apparatus according to claim 10, wherein said liquid discharge head is detachably mounted on said carriage via attaching/detaching means.

12. A liquid discharge head comprising:

a plurality of nozzle arrays each provided with a plurality of nozzles for discharging liquid and each arranged substantially in parallel to a print medium conveying direction;

and a plurality of discharge energy generating portions for discharging liquid from said nozzles, respectively, said liquid discharge head moved to scan in a direction crossing said conveying direction, said liquid discharge head;

wherein a volume of an ink droplet to be discharged from each of said nozzles differs per said nozzle array, a pitch of said nozzles arranged on both end sides of each of said nozzle arrays is greater than a pitch of said nozzles arranged at a center portion of the corresponding nozzle array, and the pitch of said nozzles arranged on both end sides of the nozzle array where a volume of an ink droplet is large, is greater than the pitch of said nozzles arranged on both end sides of the nozzle array where a volume of an ink droplet is small.

13. A head cartridge comprising the liquid discharge head according to claim 1 and a liquid tank storing liquid to be supplied to said liquid discharge head.

14. A head cartridge according to claim 13, wherein said liquid tank is detachable relative to said liquid discharge head via attaching/detaching means.

* * * * *

UNITED STATES PATENT AND TRADEMARK OFFICE

CERTIFICATE OF CORRECTION

PATENT NO. : 6,773,089 B2
DATED : August 10, 2004
INVENTOR(S) : Tomoyuki Inoue et al.

It is certified that error appears in the above-identified patent and that said Letters Patent is hereby corrected as shown below:

Column 12,
Lines 56 and 67, "do" should read -- $d_0$ --.

Signed and Sealed this

Seventeenth Day of May, 2005

JON W. DUDAS
*Director of the United States Patent and Trademark Office*